US008430279B2

(12) United States Patent
Rigel

(10) Patent No.: US 8,430,279 B2
(45) Date of Patent: Apr. 30, 2013

(54) BOTTLE ACCESSORY FOR APPLICATION WITH A CAP TO A BOTTLE, PARTICULARLY USEFUL FOR ATTACHING A RETRACTABLE SPOUT TO A BOTTLE

(76) Inventor: Doron Rigel, Moshav Aviel-Doar-Na Menashe (IL)

( * ) Notice: Subject to any disclaimer, the term of this patent is extended or adjusted under 35 U.S.C. 154(b) by 390 days.

(21) Appl. No.: 12/769,743

(22) Filed: Apr. 29, 2010

(65) Prior Publication Data

US 2011/0266251 A1 Nov. 3, 2011

(51) Int. Cl.
*B65D 23/00* (2006.01)

(52) U.S. Cl.
USPC ..... 222/567; 222/523; 222/527

(58) Field of Classification Search ..... 222/527, 222/567, 522–525, 386, 153.01; 215/386
See application file for complete search history.

(56) References Cited

U.S. PATENT DOCUMENTS

| | | | | | |
|---|---|---|---|---|---|
| 2,915,223 | A | * | 12/1959 | Beall, Jr. | 222/109 |
| 3,217,935 | A | * | 11/1965 | Burt | 222/109 |
| 3,300,104 | A | * | 1/1967 | Burt | 222/482 |
| 3,318,496 | A | * | 5/1967 | Ayotte et al. | 222/546 |
| 3,339,772 | A | | 9/1967 | Miller | |
| 3,369,710 | A | | 2/1968 | Lucas | |
| 3,543,973 | A | | 12/1970 | Berins | |
| 4,427,138 | A | | 1/1984 | Heinlein | |
| 4,696,416 | A | | 9/1987 | Muckenfuhs et al. | |
| 5,107,909 | A | * | 4/1992 | Donovan | 141/296 |
| 5,261,569 | A | * | 11/1993 | Sandwell | 222/205 |
| 5,454,489 | A | * | 10/1995 | Vesborg | 222/109 |
| 6,026,994 | A | * | 2/2000 | Rigel | 222/538 |
| 6,478,058 | B1 | * | 11/2002 | Pears | 141/353 |
| 6,976,610 | B2 | | 12/2005 | Rigel | |
| 7,334,705 | B2 | * | 2/2008 | Yashima et al. | 222/129 |
| 2003/0213812 | A1 | | 11/2003 | Kars et al. | |

OTHER PUBLICATIONS

International Search Report Dated Sep. 30, 2011 From the International Searching Authority Re. Application No. PCT/IL2011/000347.

International Preliminary Report on Patentability Dated Nov. 8, 2012 From the International Bureau of WIPO Re. Application No. PCT/IL2011/000347.

* cited by examiner

*Primary Examiner* — Paul R Durand
*Assistant Examiner* — Donnell Long

(57) ABSTRACT

A bottle accessory for application with a cap to the neck of a bottle, includes: a housing dimensioned so as to be fixedly received within the bottle neck; and a connector disc attached to the upper end of the housing and receivable within the cap to serve as an inner liner thereof when the cap is applied to the neck of the bottle. The housing and connector disc are constructed to enable the housing to be attached with the cap to the bottle neck and, once so attached, to enable the connector disc to be released from the housing, such that when the cap is removed, the connector disc will remain as a liner within the cap, while the housing will remain attached to the bottle neck. The invention is particularly useful in a retractable spout assembly wherein the housing houses a retractable spout.

9 Claims, 3 Drawing Sheets

BOTTLE ACCESSORY FOR APPLICATION WITH A CAP TO A BOTTLE, PARTICULARLY USEFUL FOR ATTACHING A RETRACTABLE SPOUT TO A BOTTLE

FIELD AND BACKGROUND OF THE INVENTION

The invention relates to a bottle accessory for application with a cap to a bottle by using conventional capping machines, while permitting the cap to be later detached from the bottle with the accessory retained within the bottle. The invention is particularly useful for applying a retractable spout assembly to bottles, and is therefore described below with respect to such an application.

The present invention is especially useful in the retractable spout assemblies disclosed in my prior U.S. Pat. Nos. 6,026,994 and 6,976,610, the contents of which are hereby incorporated reference.

My prior U.S. Pat. No. 6,026,994 describes a retractable spout assembly for application to the neck of a bottle to be closed by a cap. The assembly includes a sleeve-like housing fixedly receivable within the bottle neck, and a spout movable within the housing from a retracted position, when the housing is fixed within the bottle neck and the bottle neck closed by the cap, to an extended position projecting outwardly of the housing and the bottle neck for pouring out contents of the bottle. To make the spout automatically extendible upon removing the cap, the assembly further includes a spring biasing the spout to its extended position. Such a spring could be omitted, whereupon the spout would be manually movable to its extended position with or after removal of the cap. An air-return passageway is provided for returning air into the bottle when its liquid contents are being poured out through the spout.

My prior U.S. Pat. No. 6,976,610 describes improvements in the construction of that retractable spout assembly which not only make the assembly more compact in construction and more reliable in operation but, by including a connector disc, also enable the assembly to be accommodated by existing bottle-capping machines so that virtually no change is required in such expensive machines to enable them also to be used for applying caps incorporating retractable spout assemblies.

A drawback found to exist in the construction described in my prior U.S. Pat. No. 6,976,610 is the possibility that, after the cap and spout assembly have been applied to the bottle, removal of the cap with the connector disc may also tend to pull out the spout housing from the bottle.

OBJECTS AND BRIEF SUMMARY OF THE INVENTION

An object of the present invention is to provide a bottle accessory for application with a cap to the neck of a bottle, which assembly better assures the release of the housing from the connector disc when the cap is removed with the connector disc from the bottle neck.

According to a broad aspect of the present invention, there is provided a bottle accessory for application with a cap to the neck of a bottle, comprising: a housing dimensioned to be fixedly received within the bottle neck; and a connector disc attached to the upper end of the housing and receivable within the cap to enable the disc and housing to be applied with the cap to the neck of the bottle; characterized in that the upper end of the housing is formed with an annular groove spaced inwardly of the outer peripheral edge of the housing and extending axially of the housing, and in that the connector disc includes a lower face having an annular peripheral surface dimensioned to be fixedly received within the cap to serve as a liner therefor, and further characterized in that the lower face of the connector disc also includes an annular rib spaced inwardly of the periphery of the disc, the annular rib extending axially of the housing and being dimensioned to be releasably retained within the annular groove in the upper end of the housing such that the disc facilitates the attachment of the housing with the cap to the bottle neck, and releases from the housing upon removal of the cap from the bottle neck, to thereby enable the connector disc to also serve as a liner for the removed cap while the housing remains within the bottle neck.

According to the preferred embodiments of the invention described below, the annular groove in the upper end of the housing includes an outer annular side wall and an inner annular side wall spaced inwardly from the outer annular side wall, the outer annular side wall having an inner surface formed with a radially-extending annular groove, and the outer surface of the annular rib in the lower face of the connector disc having a radially-extending annular bead receivable in the annular groove. The upper end of the housing includes an upper section formed with the axially-ending annular recess, and an underlying section formed with threads for receiving the cap. The upper section of the housing further includes an elastic juncture between the upper and underlying sections of the housing.

Two embodiments of the invention are described below for purposes of example. In one described embodiment, the upper section of the housing has a smaller outer diameter than that of the underlying section of the housing to define an annular space for accommodating radial deflection of the upper section at the elastic juncture and thereby to facilitate release of the connector disc from the housing upon removal of the cap from the bottle neck after insertion of the housing within the bottle neck. In this embodiment, the spout housing is dimensioned such that the outer end of its upper section is substantially flush with the outer end of the bottle neck when the spout housing is inserted therein.

In a second described preferred embodiment, the upper section of the housing has a larger outer diameter than that of the underlying section of the housing and the housing includes an axially-extending annular recess inwardly of its underlying section to define an annular space permitting inward radial deflection of the underlying section, and thereby outward radial deflection of the upper section, at the elastic juncture. This facilitates release of the connector disc from the housing upon removal of the cap from the bottle neck after insertion of the housing within the bottle neck. In this embodiment, the spout housing is dimensioned such that the outer end of its upper section projects outwardly of the outer end of the bottle neck when the spout housing is inserted therein.

As indicated above, the invention is particularly useful for retractable spout assemblies to be applied to the bottle neck, and is therefore described below with respect to that application.

Accordingly, according to a more specific aspect of the present invention, there is provided a retractable spout assembly for application with a cap to the neck of a bottle, comprising: a spout housing dimensioned so as to be fixedly received within the bottle neck; a spout movable within the spout housing from a retracted position within the spout housing, when the housing is fixed within the bottle neck and the cap is applied over the bottle neck, to an extended position projecting outwardly of the spout housing and the bottle neck for pouring out contents of the bottle; and a connector disc attached to the upper end of the housing to be applied with the cap to the neck of the bottle; characterized in that the upper end of the spout housing is formed with an annular groove spaced inwardly of the outer peripheral edge of the spout housing and extending axially of the housing, and in that the connector disc includes a lower face having an annular peripheral surface dimensioned to be fixedly received within the cap to serve as a liner therefor; and further characterized in that the lower face of the connector disc also includes an annular rib spaced inwardly of the periphery of the connector disc; the annular rib extending axially of the spout housing and being dimensioned to be releasably retained within the annular groove in the upper end of the spout housing, such that the connector disc facilitates the attachment of the spout housing with the cap to the bottle neck, and releases from the spout housing upon removal of the cap from the bottle neck, to thereby enable the disc also to serve as a liner for the removed cap while the spout housing and spout remains within the bottle neck.

Further features and advantages of the invention will be apparent from the description below.

It is to be understood that the foregoing drawings, and the description below, are provided primarily for purposes of facilitating understanding the conceptual aspects of the invention and possible embodiments thereof, including what is presently considered to be a preferred embodiment. In the interest of clarity and brevity, no attempt is made to provide more details than necessary to enable one skilled in the art, using routine skill and design, to understand and practice the described invention. It is to be further understood that the embodiments described are for purposes of example only, and that the invention is capable of being embodied in other forms and applications than described herein.

DESCRIPTION OF PREFERRED EMBODIMENTS

Figure 1:
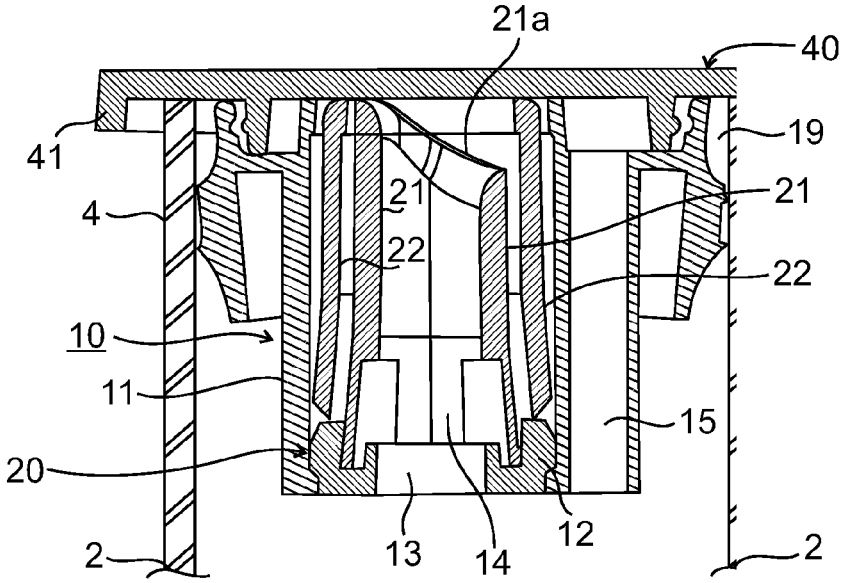
FIG. 1 illustrates one form of retractable spout assembly constructed in accordance with the present invention to be received within a bottle neck.
Figure 2:
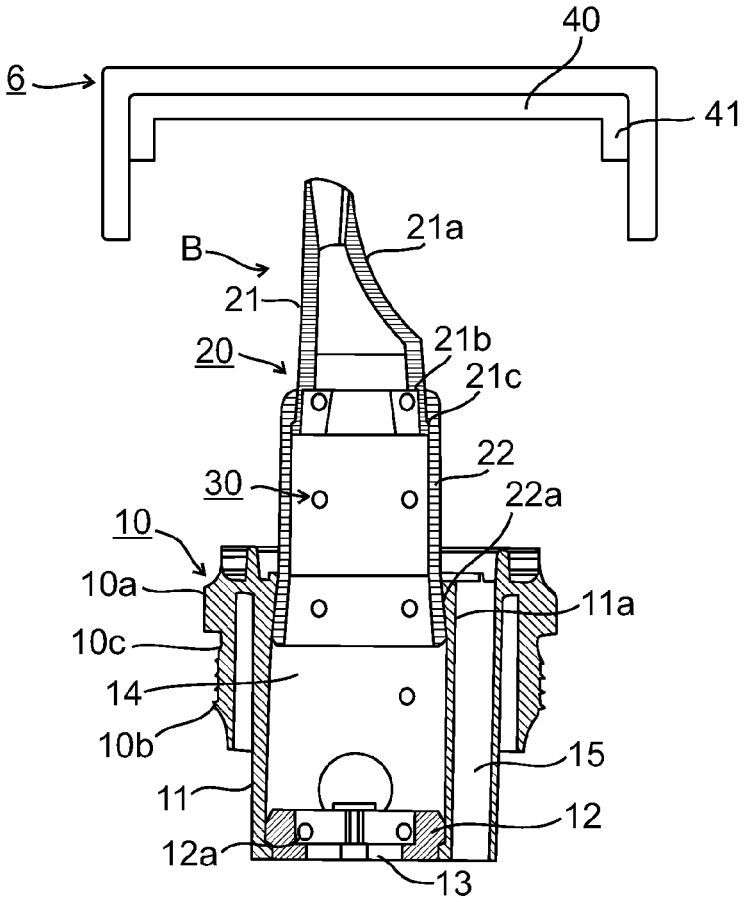
FIG. 2 illustrates the retractable spout assembly of FIG. 1 after removal of the cap and with the spout in its projected position for pouring out contents from the bottle.
Figure 3:
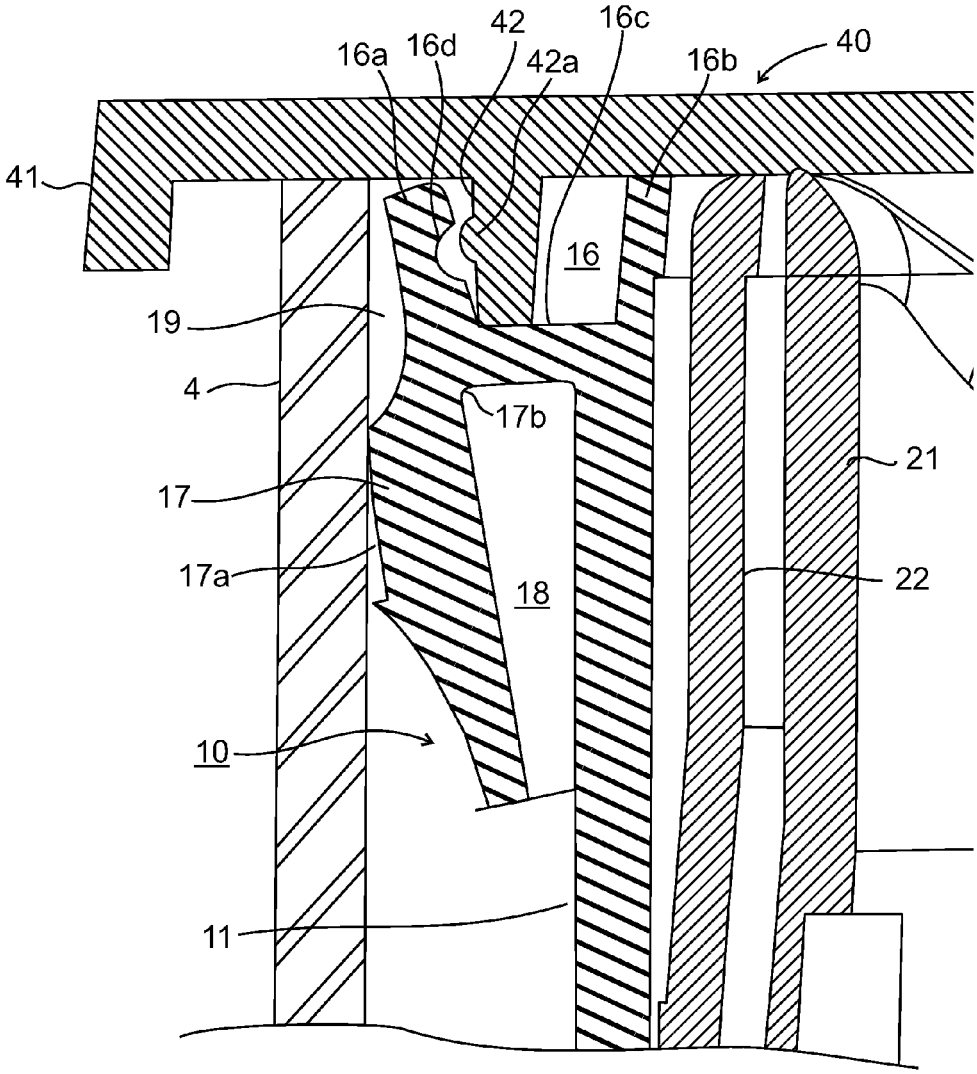
FIG. 3 is an enlarged fragmentary view of a portion of FIG. 1 more clearly showing the manner in which its connector disc is attached to the spout assembly to better assure release of the housing from the connector disc when the cap, with the connector disc serving as a liner thereof, is detached from the bottle neck.

The Embodiment of FIGS. 1-3

FIGS. 1-3 illustrate a retractable spout assembly of the type described in my prior U.S. Pat. No. 6,976,610 applied to a bottle, schematically illustrated at 2, formed with a neck 4 closed by a cap 6 (FIG. 2). The spout assembly, generally designated 8 in FIGS. 1 and 2, is fixedly received within neck 4 of the bottle 2 so that it does not have to be repeatedly applied and removed. Thus, whenever cap 6 is removed, the spout within the assembly 8 automatically moves to an extended position (FIG. 2) to enable it to be used for pouring out the bottle contents; and whenever the cap is re-applied, it automatically moves the spout back to its retracted position (FIG. 1).

The spout assembly 8 includes a housing, generally designated 10, to be fixedly receivable within the bottle neck 4; a spout, generally designated 20, extending through the housing and movable therein to an extended position (FIG. 2) projecting outwardly of the bottle neck to facilitate pouring the contents from the bottle, and to a retracted position (FIG. 1) disposed within the bottle neck when closed by the cap 6; and a coiled spring, generally designated 30 (FIG. 2), normally urging the spout 20 to its extended position, but compressible to automatically move the spout to its retracted position upon application of the cap to the bottle neck 4.

Housing 10 includes a cylindrical section 11 having, at its lower end, an insert 12 formed with an opening 13 to communicate with the interior of the bottle 2 when the spout assembly is applied to the bottle neck.

Spout assembly 20 includes two telescoping sections 21, 22. The outer end 21*a* of the outer telescoping section 21 is of a tapered cross-section to facilitate discharging the liquid from the bottle into a glass or other receptacle. The opposite end of telescopic section 21 is formed with an annular shoulder 21*b* on its inner surface to serve as a seat for spring 30, and with an outer annular shoulder 21*c* engageable with a corresponding shoulder in the inner surface of telescopic section 22, to limit the outward movement of telescopic section 21.

Telescoping section 22 is formed, at its opposite end, with an outwardly tapered surface 22*a* cooperable with an inwardly-tapered surface 11*a* at the corresponding end of the housing cylindrical section 11, to limit the projected position of telescopic section 22.

The cylindrical section 11 of housing 10 is formed with two passageways, namely: a first passageway 14 for the liquid (or other pourable material) to be poured from the bottle 2; and an air passageway 15 for returning air into the interior of the bottle when its contents are being poured.

It will thus be seen that each time cap 6 is removed, the spout 20 is automatically moved to its extended position by spring 30 to enable the spout to be used for pouring out contents of the bottle via passageway 14 of the spout, while air is returned into the interior of the bottle via passageway 15. When cap 6 is re-applied to the bottle neck 4, spout 20 is automatically moved by the cap to its retracted position, which is permitted by the compression of spring 30. Accordingly, each time the cap is to be re-applied to a bottle containing the spout assembly, it is not necessary to remove the spout assembly as in conventional spout constructions.

In the construction illustrated in FIGS. 1-3, the assembly further includes a connector disc, generally designated 40. Disc 40 actually serves two functions: Its primary function is to serves as a connector for connecting the retractable spout assembly to cap 6 and for retaining the assembly within the cap, to thereby enable the cap, with the retractable spout assembly, to be handled by existing bottle-filling and capping machines. Disc 40 also serves as a liner for the cap when attached to the bottle which seals the bottle when the cap is applied with the spout 20 in its retracted position, as illustrated in FIG. 1.

According to the present invention, the upper end of the spout housing 10, and the under surface of the connector disc 40, are constructed in a manner to enable the connector disc 40, with the spout housing 10, to be applied to the cap using conventional capping machines, while at the same time better assuring the release of the spout housing from the connector disc when the cap is detached from the bottle, such that the connector disc will be retained within the cap to serve as a liner therefor, and the spout housing will be retained in the bottle neck to thereafter facilitate pouring contents therefrom when the cap is removed.

Thus, as shown particularly in the enlarged fragmentary view of FIG. 3, the upper part of cylinder 11 of the housing 10 is integrally formed with an annular groove or recess 16 defined by an annular outer side wall 16*a*, an inner annular side wall 16*b*, and a bottom wall 16*c*. The inner surface of the outer annular side wall 16*a* is formed with a radially-extending groove 16*d*.

The inner face of connector disc 40 is formed with an annular wall or rib 42 receivable within annular groove 16 and of smaller thickness than the width of the groove. The outer surface of annular rib 42 is formed with a radially-extending enlarged, rounded bead formation 42*a* receivable within annular groove 16*d* of the outer annular wall 16*a* at the upper end of the housing cylinder 11.

The upper end of housing cylinder 11 is further formed with a section 17 underlying side wall 16*a* and formed with thread 17*a* for receiving the bottle cap (6, FIG. 2). Section 17 of the housing is radially spaced from the upper end of housing cylinder section 11 by a deep annular recess 18. Preferably, section 17 has a thickness at its threaded portion 17*a* greater than the thickness of the bottom wall 16*c* of recess 16, such that an elastic juncture 17*b* is formed between bottom wall 16*c* of the upper housing section and the underlying section 17.

In the embodiment of FIGS. 1-3, the outer surface of annular wall 16*a* of the housing is reduced in outer diameter to define an annular space 19 between it and bottle neck 4, for accommodating outward radial deflection of wall 16*a* of the housing, as will be described below.

The embodiment of FIGS. 1-3 thus operates as follows: Initially, the spout housing 10, including the spout assembly 20, is attached to the connector disc 40 by merely snapping annular rib 42 of the connector disc into recess 16 of the housing. In such case, rib 42*d* of wall 42, received within annular groove 16*d* of wall 16*a*, firmly but releasably retains the spout assembly attached to the connector disc. Thus, the connector disc 40, with the spout assembly releasably attached thereto, may be used in conventional capping machines for capping the connector disc and spout assembly to the cap.

When the cap, and the spout assembly attached thereto, are inserted into a bottle neck 4, the forceful insertion of the upper end of the housing causes the upper end to be flexed outwardly, this being permitted by the elastic juncture 17*b* between the upper and underlying sections of the housing. This outward flexing of outer annular wall 16*a* is accommodated by space 19 and moves the annular groove 16*d*, in the upper end of annular wall 16*a*, away from the bead 42*a* in the annular rib 42 of the connector disc 40.

Accordingly, when the connector disc 40 has been received within the cap, the connector disc is firmly but releasably attached to the spout assembly. However, when the spout assembly and cap are inserted into the bottle neck, the connector disc is released from the spout assembly by withdrawal of rib 42*a* from groove 16*d*. Accordingly, whenever thereafter the cap is removed from the bottle, connector disc 40 will be retained within the cap, to serve as a liner thereof, while the spout assembly will remain fixed within the bottle neck.

It will thus be seen that the construction illustrated in FIGS. 1-3 enables the spout assembly to be releasably attached to the connector disc 40 so that both can be applied to bottles using conventional capping machines, and that whenever the cap is thereafter to be removed from a bottle, the connector disc will be retained within the cap to serve as a liner thereof, while the spout assembly will remain fixed within the bottle and will automatically move to its extended position.

Figure 4:
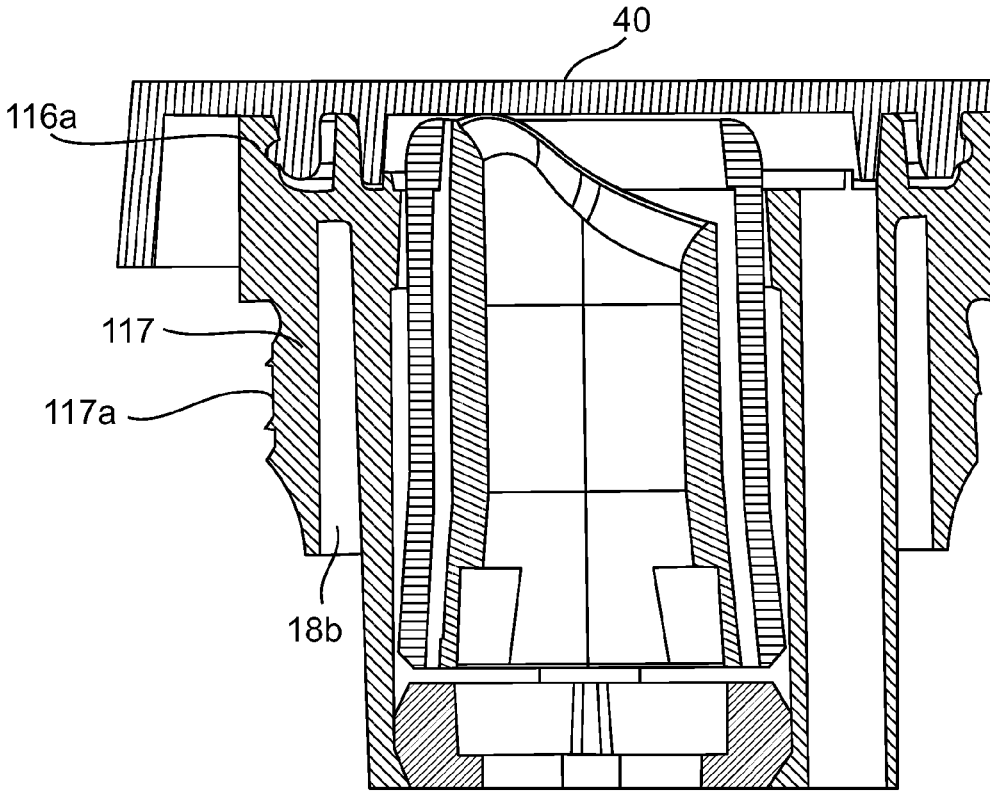
FIGS. 4 and 5 are views corresponding to those of FIGS. 1 and 3, but illustrating a second embodiment of the invention.
Figure 5:
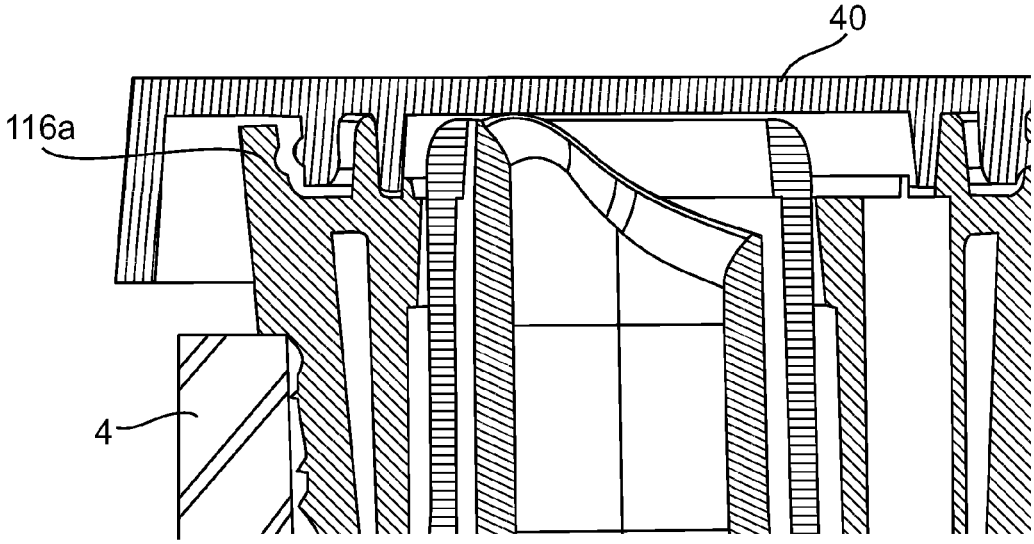

The Embodiment of FIGS. 4 and 5

FIGS. 4 and 5 illustrate an embodiment similar to that of FIGS. 1-3, but with the following modification.

Thus, as described above, in the FIGS. 1-3 embodiment, the upper section of the housing formed with annular wall 16*a* has a smaller outer diameter than that of the underlying section 17 formed with the thread 17*a*, to define space 19 for accommodating the deflection of the annular wall 16*a* to release the spout assembly from connector disc 40 when the cap and spout assembly are forcefully applied to the bottle neck. In such an arrangement, the housing 10 is dimensioned such that the outer end of its upper section, containing the annular wall 16*a*, is substantially flush with the outer end of the bottle neck so that the complete spout assembly is fixed flush with the bottle neck.

FIGS. 4 and 5 illustrate a modification wherein the upper section of the housing containing the annular wall, therein designated 116*a*, has a larger outer diameter than the underlying section 117 formed with the threads 117*a*. In such a construction, the housing is dimensioned such that the outer end of its upper section projects outwardly of the outer end of the bottle neck when the spout assembly is inserted therein. In this case, the deflection of the upper housing section is permitted by the space between it and the bottle cap (6, FIG. 2) since annular wall 116*a* of the upper housing section is not engaged by the bottle neck, which engages only threads 117*a* of the underlying housing section.

In all other respects, the retractable spout assembly illustrated in FIGS. 4 and 5 is constructed and operates in substantially the same manner, as described above with respect to the embodiment of FIGS. 1-3.

While the invention has been described with respect to two preferred embodiments, including a particular structure of a retractable spout assembly, it will be appreciated that the invention could be used with respect to other spout assemblies, and also with respect to other bottle accessories to be attached within a bottle neck, such as dosing devices, anti-drip devices, etc. Many other variations, modifications and applications of the invention will be apparent.

What is claimed is:

1. A bottle accessory for application with a cap to the neck of a bottle, comprising:

(a) a housing dimensioned to be fixedly received within the neck of the bottle;

(b) a connector disc including an annular rib engaging an upper end of said housing, said connector disc being receivable within the cap to enable said connector disc and said housing to be carried within the cap when applied to the neck of the bottle;

wherein, when inserted within the neck of the bottle a portion of said housing deforms thereby disengaging said annular rib from said housing and enabling release of said connector disc from said housing, such that when the cap is removed from the bottle neck said connector disc remains attached to said cap to serve as a liner for the removed cap while said housing remains within the neck of the bottle.

2. The accessory according to claim 1, wherein said housing includes an annular side wall formed with a radially-extending annular groove, for engaging n annular bead formed in said annular rib.

3. The accessory according to claim 1, wherein said upper end of said housing includes an upper section formed with an axially-ending annular recess, and an underlying section formed with threads for receiving said cap.

4. The accessory according to claim 3, wherein said upper section of said housing further includes an elastic juncture between said upper and underlying sections of the housing.

5. The accessory according to claim 4, wherein said upper section of said housing has a smaller outer diameter than that of said underlying section of said housing to define an annular space for accommodating radial deflection of said upper section at said elastic juncture and thereby to facilitate release of said connector disc from said housing upon removal of the cap from the neck of the bottle after insertion of said housing within the neck of the bottle.

6. The accessory according to claim 5, wherein said housing is dimensioned such that the outer end of its upper section is substantially flush with the outer end of the neck of the bottle when the housing is inserted therein.

7. The accessory according to claim 4, wherein said elastic juncture is of smaller thickness than said threaded section to increase the elasticity of said juncture.

8. The accessory according to claim 1, wherein said accessory within said housing is a retractable spout assembly movable within said housing from a retracted position within the housing when said housing is fixed within the neck of the bottle with the cap applied over the neck of the bottle, to an extended position projecting outwardly of said housing and the neck of the bottle when the cap is removed therefrom for pouring out contents of the bottle.

9. The accessory according to claim 7, wherein said housing further includes an air-return passageway for returning air into the bottle when contents therein are being poured out through said spout.

* * * * *